US005908518A

United States Patent [19]

Hoffmann et al.

[11] Patent Number: 5,908,518

[45] Date of Patent: Jun. 1, 1999

[54] ALMGMN ALLOY PRODUCT FOR WELDED CONSTRUCTION WITH IMPROVED CORROSION RESISTANCE

[75] Inventors: Jean-Luc Hoffmann, Moirans; Martin Peter Schmidt, La Murette, both of France

[73] Assignee: Pechiney Rhenalu, Courbevoie, France

[21] Appl. No.: 08/899,691

[22] Filed: Jul. 25, 1997

[30] Foreign Application Priority Data

Aug. 6, 1996 [FR] France ..... 96 10085

[51] Int. Cl.[6] ..... B32B 15/20; C22C 21/08; C22F 1/04

[52] U.S. Cl. ..... 148/440; 420/535; 420/544; 420/546

[58] Field of Search ..... 428/654; 148/440, 148/415, 417, 418; 420/548, 544, 534, 535, 546

[56] References Cited

U.S. PATENT DOCUMENTS

| | | | |
|---|---|---|---|
| 3,502,448 | 3/1970 | Anderson et al. | 428/923 |
| 4,108,688 | 8/1978 | Broverman | 148/440 |
| 4,412,870 | 11/1983 | Vernam et al. | 148/440 |
| 4,659,396 | 4/1987 | Lifka et al. | 148/439 |
| 5,141,703 | 8/1992 | Schmid et al. | 420/544 |
| 5,181,969 | 1/1993 | Komatsubara et al. | 148/440 |
| 5,234,759 | 8/1993 | Inabayashi et al. | 420/546 |
| 5,240,522 | 8/1993 | Tanaka et al. | 148/440 |
| 5,244,516 | 9/1993 | Kawaguchi | 148/439 |
| 5,516,374 | 5/1996 | Habu et al. | 148/440 |
| 5,534,357 | 7/1996 | Nonoyama et al. | 428/654 |
| 5,667,602 | 9/1997 | Fang et al. | 420/544 |

FOREIGN PATENT DOCUMENTS

| | | | |
|---|---|---|---|
| 222479 A1 | 5/1987 | European Pat. Off. | 148/440 |
| 61-199056 | 9/1986 | Japan | 420/544 |

*Primary Examiner*—John J. Zimmerman
*Attorney, Agent, or Firm*—Dennison, Meserole, Pollack & Scheiner

[57] ABSTRACT

The invention relates to a rolled or extruded AlMgMn aluminum alloy product for welded mechanical construction with the composition (% by weight): 3.0<Mg<65, 0.2<Mn<1.0, Fe<0.8, 0.05<Si<0.6, Zn<1.3, possibly Cr<0.15 and/or one or more of the elements Cu, Ti, Ag, Zr, V at a content of<0.30 each, other elements and inevitable impurities <0.05 each and <0.15 in total, in which the number of $Mg_2Si$ particles between 0.5 $\mu$m and 5 $\mu$m, in size is between 150 and 2,000 per $mm^2$, and preferably between 300 and 1,500 per $mm^2$. The products according to the invention have good corrosion resistance and are used for structural applications such as for example, boats, offshore structures or industrial vehicles.

20 Claims, No Drawings

ALMGMN ALLOY PRODUCT FOR WELDED CONSTRUCTION WITH IMPROVED CORROSION RESISTANCE

TECHNICAL FIELD

The invention relates to the field of rolled or extruded products such as sheets, strips, tubes, bars, wires or sections made from an aluminum alloy of the AlMgn type with Mg>3% by weight, intended for welded structures which, in addition to high yield strength, good fatigue strength and good toughness, require good corrosion resistance for structural applications such as, for example, boats, offshore structures or industrial vehicles.

PRIOR ART

It is known that the utilization of AlMg alloys of the 5000 series according to the Aluminum Association nomenclature in the strain-hardened temper (H temper according to NF EN 515), whether completely strain-hardened (H1 temper), partially annealed (H2 temper) or stabilized (H3 temper), makes it possible to obtain good mechanical properties and good corrosion resistance. By way of example, the alloys 5083 and 5086 are widely used in the field of mechanical construction, whether welded or not, for applications which require suitable corrosion resistance.

However, after welding, the heat-affected area around the welded joint is in the annealed state (O temper), with diminished mechanical properties, which does not allow full advantage to be taken of the mechanical properties of the material in welded constructions. In effect, the certification and control authorities generally recommend that only the mechanical properties in the O temper be taken into account in the determining the size of a structure.

It is well known that the utilization of alloys with higher magnesium and manganese contents makes it possible to enhance the mechanical properties in the O temper. However, this is generally detrimental to corrosion resistance and fatigue strength, and increases the crack propagation rate.

For this reason, there exists in the standard NF EN 515 a specific metallurgic temper (H116) for alloys of the 5000 series containing at least 4% magnesium, to which specified limits of mechanical properties and exfoliating corrosion resistance apply.

It is also for this reason that certain mechanical construction design codes limit the use of alloys of the 5000 series containing more than 4% magnesium in a corrosive environment if the temperature of the piece while in service runs the risk of exceeding a specified temperature between 65 and 80° C. In effect, it is known that these alloys are susceptible to a thermal sensitization to corrosion, a cumulative effect which is made manifest by the intergranular precipitation of $Al_3Mg_2$, thus reducing the cohesiveness of the grains. It is linked to the fact that, starting at a magnesium content higher than 3%, a significant fraction of the magnesium is in supersaturated solution and can precipitate during the reheating of the corroded metal (see: D. Altenpohl, "Aluminum and Aluminum Alloys", Berlin/Göttingen 1965, pp. 654 and 675) This effect, which has long been known, appears to be inevitable and ultimately limits, via the magnesium content, the mechanical properties of welded products made from AlMgMn alloys for mechanical construction, and more particularly for welded mechanical construction. For this reason, AlMg and AlMgMn welding alloys with a magnesium content higher than 5.6% are considered to be of no interest (cf: Aluminum Handbook, 14th edition, Dusseldorf 1983, p. 44).

In order to improve the mechanical properties, research projects have mainly concentrated on two aspects: the control of the welding operation itself, so as to improve the mechanical properties of the welded joint, particularly its fatigue strength; and thermomechanical treatments for improving the corrosion resistance of the piece. However, there is a practical limit to these attempts to improve AlMgMn alloys, since any progress made in this field can only be applied to industrial practice on the condition that it avoids costly and complex thermomechanical treatments, and results in a manufacturing program that ensures reliable production. The latter condition implies that a slight variation in a production parameter, for example the temperature of the metal at the outlet of the hot-rolling mill, must not result in a substantial change in the properties of the final product.

Thus, the Japanese patent applications JP 06-212373 and JP 06-93365, which relate to AlMgMn alloys transformed according to complex processes whose reliability is difficult to ensure, do not meet the objective.

Likewise, European patent application EP 0385257 (Sumitomo Light Metal Industries, Ltd.) claims the application of a complex and not very reliable thermomechanical treatment method to an alloy containing, among other elements, from 4.0 to 6.0% magnesium and from 0.1 to 10% manganese. The application envisaged is not mechanical construction, but can ends; the technical properties (especially the pitting corrosion resistance) of this product compare favorably to those of the known products for this application, but do not meet the requirements of welded mechanical construction.

German patent application DE 2443443 (Siemens AG) claims a machine component made from a weldable aluminum alloy containing, among other elements, 3.5 to 4.9% Mg and 0.5 to 1.5% Mn. No information is given on the mechanical properties or the corrosion resistance of this product.

European patent application EP 0507411 (Hoogovens Aluminium) describes the application of a complex thermomechanical treatment process to an AlMgMn alloy containing, among other elements, 0.8 to 5.6% Mg, up to 1% Mn and certain other elements such as Fe, Ni, Co, Cu, Cr and Zn. The product thus obtained is characterized by good ductility, particularly good elongation at rupture, and the absence of Lüders lines. It does not meet the needs of corrosion resistant welded construction.

European patent EP 0015799 (Ateliers et Chantiers de Bretagne) discloses a weldable alloy containing, among other elements, 3.5 to 4.5% magnesium and 0.2 to 0.7% manganese for the manufacture of tubes for cryogenic applications. This application does not raise the problem of thermal sensitization to corrosion, and the document mentions neither the mechanical properties nor the other usual properties of the product.

U.S. Pat. No. 4,043,840 (Swiss Aluminium, Ltd.) describes an AlMg alloy without manganese containing, among other elements, 2.0 to 6.0% magnesium and 0.03 to 0.20% vanadium. The vanadium reduces the intrinsic electrical conductivity of the metal and increases the contact resistance of the sheet, thus rendering it particularly suitable for spot welding. The product is intended for automobile body reinforcements; the properties pertinent to structural applications are not described.

Finally, U.S. Pat. No. 3,502,448 (Aluminum Company of America) describes an alloy containing, among other elements, 4 to 5.5% magnesium, 0.2 to 0.7% manganese, which by means of cold-rolling results in thin sheets and strips suitable for the production of beverage can ends, on condition that the relationship between the Mg and Mn contents conforms to a certain algebraic relation. This patent does not relate to the field of welded mechanical construction either.

Recently, in two French patent applications, the inventors presented a novel approach to the improvement of AlMgMn products for structural applications, based on the development of novel compositions of the alloy.

French patent application 95-12065 relates to a particular alloy composition, ultimately registered with the Aluminum Association under the designation 5383, containing among other elements from 3 to 5% magnesium and from 0.5 to 1% manganese, in which the sum of the contents (in % by weight) Mn+2Zn is >0.75. This composition makes it possible to obtain rolled or extruded products having significantly better fatigue strength and a significantly lower crack propagation rate than the known products intended for the same application. However, the patent application cited does not give any indication as to the corrosion resistance of the product. The alloy was presented in a paper entitled "New Aluminum Products for High-Speed Light Crafts" by G. M. RAYNAUD at the Second International Forum on Aluminum Ships in Melbourne on Nov. 22–23, 1995.

French patent 95-12466 claims a very narrow range of composition inside the compositional ranges of the alloys 5083 and 5086, containing among other elements, 4.3 to 4.8% magnesium and less than 0.5% manganese, which makes it possible to obtain good properties during large deformations. This application does not mention corrosion resistance either.

The object of the invention, therefore, is to offer rolled, extruded, or drawn AlMgMn alloy products having, after welding, improved corrosion resistance and better resistance to the sensitizing effect of temperature exposure, while retaining good mechanical properties after welding and good fatigue strength, and being able to be produced at lower cost.

SUBJECT OF THE INVENTION

The inventors found that AlMgMn alloys can be rendered more resistant to the sensitizing effect of temperature exposure when they have a particular well-defined microstructure which results from a set of parameters of the manufacturing process.

Thus, the subject of the invention is an AlMgMn alloy product for welded mechanical construction with the following composition (% by weight):

3.0<Mg<6.5 0.2<Mn<10 Fe<0.8 0.05<Si<0.6 Zn<1.3 possibly Cr at a content<0.15 and/or one or more of the elements Cu, Ti, Ag, Zr, V at a content <0.3 each, the other elements being <0.05 each and <0.15 in total, in which the number of $Mg_2Si$ particles between 0.5 and 5 pm in size is between 150 and 2,000 per $mm^2$, and preferably between 300 and 1,500 per $mm^2$.

DESCRIPTION OF THE INVENTION

The inventors found, surprisingly, that for the obtainment of the properties sought, the microstructure has a preponderant influence. More particularly, in the high magnesium content range, that is higher than about 5%, the thermal corrosion sensitivity of the material is considerably reduced. This improved corrosion resistance makes it possible to incorporate more magnesium in order to obtain mechanical properties equivalent to those of the known AlMgMn alloys which are unsuitable for use in a corrosive environment.

More precisely, there are four types of phases which influence the properties sought: the eutectic $Mg_2Si$ phases, the eutectic AlFeMnSi phases, the eutectic $Al_6$(Mn,Fe) and AlFeCr phases, and the manganese dispersoids of distinctly sub-micronic size, which are found in the grain.

The particular microstructure according to the invention is characterized by a novel distribution, in size and in quantity, of these known phases. This microstructure was characterized in the following way, which is well known in micrography. A ground section of the metal is prepared and is observed by means of light microscopy or scanning electron microscopy. Light microscopy makes it possible to easily identify the $Mg_2Si$ phases in relation to the other phases present. Scanning electron microscopy lends itself more to the characterization of the phases less than 0.5 $\mu$m in size; using the backscattered electron mode, it also makes it possible to distinguish the $Mg_2Si$ phases.

In order to determine the size of the particles, digital analysis of the micrographs is used to estimate their area A, from which the size parameter d is calculated according to the formula $d=\sqrt{4A/\pi}$. It is this parameter which will hereinafter be designated by the size of the particles.

It is well known that the $Mg_2Si$ phases contain the largest portion of the silicon present in these alloys, and that these phases, particularly in the alloys containing in excess of 3 to 4% Mg, are practically insoluble (see L. F. Mondolfo, "Aluminium Alloys, Structure and Properties", London 1976, p. 807). Consequently, their number and their size are determined during casting and remain practically unchanged in the course of the thermomechanical treatment of the product, on condition that the melting (burning) point of these phases, which constitute the most meltable eutectic, is not reached. The silicon content corresponds to the impurity level of the base metal.

The inventors found that the increase in the number of small $Mg_2Si$ particles (from 0.5 to 5 $\mu$m in size) causes an unexpected improvement in the corrosion resistance of both welded structures and unworked sheets. This effect is particularly pronounced when the number of $Mg_2Si$ particles is between 150 and 20000 particles/$mm^2$, and preferably between 300 and 1,500 particles per $mm^2$. Above 2,000 particles per $mm^2$, no additional effect on the corrosion resistance is observed; in some cases, even a reduction in the yield strength is observed after welding. In addition, the inventors found that reducing the size of the $Mg_2Si$ particles improved the fatigue strength of the welded joints. Thus, the number of "coarse" particles (>5 $\mu$m in size) must represent only a limited part of all the particles (>0.5 $\mu$m in size), typically less than 25%, and preferably less than 20%. Finally, the surface fraction of the $Mg_2Si$ particles, also measured by image analysis from light microscopy, must be less than 1%, and preferably less than 0.8%.

It is well known that the eutectic AlFeMnSi, $Al_6$(Mn,Fe) and AlFeCr phases (>0.5 $\mu$m in size) contain part of the Mn, Si and Cr present in the alloy and do not contribute to the hardening of the alloy or its corrosion resistance. They trap part of the Mn, the Cr and the Si. It is known that these phases are insoluble, and their size, number and morphology are determined during casting.

The inventors found that reducing the size and the number of these phases improves the fatigue strength and the mechanical properties of the metal. The number of particles of this type>0.5 $\mu$m in size must be less than 5,000 per $mm^2$, and preferably 2,500 per $mm^2$. The surface fraction of the particles >0.5 $\mu$m in size must be <3%, and preferably <2%, it being understood that the number of coarse particles greater than 5 μm in size must not represent more than 25% (preferably 20%) of all the particles>0.5 μm in size. Moreover, a reduction of the volume fraction of these eutectic phases results in an improvement in the corrosion resistance.

It is well known that the dispersoids (Al, Mn, Fe, Cu) smaller than 0.2 μm improve the mechanical properties of the product, particularly the yield strength of the welded joint. The inventors observed a strong influence of the dispersoid fraction on the corrosion resistance: the sensitizing effect of temperature exposure is sharply reduced when the surface fraction of dispersoids exceeds 0.5%, and preferably 1%.

The invention can be applied to a vast range of composition, and the compositional limits retained are explained in the following way:

It is well known that magnesium ensures good mechanical strength. Above 3.5%, and particularly above 3.0%, the alloy does not generally have any corrosion problems and the present invention offers little advantage. Above 605%, the problem of thermal sensitization to corrosion becomes so great that even the use of the present invention no longer makes it possible to obtain products that are usable in a corrosive environment.

Manganese improves tensile strength and reduces the tendency of the metal to recrystallize, which is known to one skilled in the art. Above 0.2%, the present invention is of no industrial advantage since the tensile strength is too low. Below 1%, the elongation, the toughness and the fatigue strength become too low for the applications envisaged.

Zinc, in the presence of manganese, improves tensile strength, but above 0.5 to 0.7%, inventors, when testing corrosion resistance of a welded zone after aging, especially in a marine environment, observed some cases of failure. For Zn contents higher than 0.5%, it appears to be necessary to protect the welded zone from contact with the corrosive environment, for example, by paint or metallization. It was found that the presence of 0.2 to 0.3% zinc makes it possible to increase the magnesium content without increasing the thermal sensitivity of the material to exfoliating corrosion.

Copper and chromium also have a favorable effect on yield strength, but it is imperative that the chromium content be limited to 0.15% in order to retain good fatigue strength. The copper content is strictly limited to 0.25% and preferably must not exceed 0.18% in order to avoid the appearance of corrosion pitting in a corrosive environment.

The iron content does not have much influence within the scope of the present invention; it must be less than 0.8% to avoid the formation of primary phases during casting, whereas for high manganese contents, it is preferable that it not exceed 0.4%.

The silicon content must be high enough to ensure the formation of silicon phases such as $Mg_2Si$, and at least 0.05%, but must not exceed 0.6%. The alloy may contain, for specific applications, titanium, silver, zirconium or vanadium in an amount lower than 0.15%.

The inventors was unable to determine a notable influence of the other impurities limited by the existing standards to 0.05% per element, their total not exceeding 0.15%.

Another subject of the invention relates to the manufacture of products having the microstructure described above in the form of wide hot-rolled strips, greater than 2,500 mm in width, preferably greater than 3,300 mm in width. This type of width makes it necessary to forego cold rolling, since cold-rolling mills are not designed to allow the rolling of such a width. This means that the strip or the sheet having all of the properties described is produced directly by hot-rolling, which is possible with the invention.

The utilization of the products thus obtained for mechanical construction, preferably welded construction, such as for example shipbuilding, offshore construction or the construction of industrial vehicles, constitutes another subject of the present invention. The products according to the invention have high yield strength after welding, which of course depends on the Mg content, and which is greater (in MPa) than 40+20×% Mg. The fatigue strength after welding, measured under plane bending strain with R=0.1, is greater than 140 MPa at $10^7$ cycles. The deformation at cutting of the sheets, measured in the H22 temper after leveling and stretching, is less than 3 mm; without stretching, that is after leveling only, it is less than 5 mm.

EXAMPLES

Industrial-size plates were produced by semi-continuous vertical casting from four alloys whose compositions are indicated in Table 1.

TABLE 1

| No. | Mg | Si | Fe | Mn | Cr |
|---|---|---|---|---|---|
| 1 | 5.2 | 0.10 | 0.18 | 0.80 | 0.12 |
| 2 | 4.4 | 0.15 | 0.25 | 0.50 | 0.10 |
| 3 | 4.0 | 0.20 | 0.27 | 0.30 | 0.05 |
| 4 | 4.7 | 0.04 | 0.12 | 0.60 | 0.10 |

The casting parameters for 10 examples are indicated in Table 2.

TABLE 2

| Ex. | Casting temperature in ° C. | Casting speed in mm/min | Refining used in kg/t of refining agent AT5B |
|---|---|---|---|
| 1 | 695 | 50 | 1 |
| 2 | 685 | 42 | 1.5 |
| 3 | 675 | 30 | 2 |
| 4 | 695 | 50 | 1 |
| 5 | 685 | 42 | 1.5 |
| 6 | 675 | 30 | 2 |
| 7 | 695 | 50 | 1 |
| 8 | 685 | 42 | 1.5 |
| 9 | 675 | 30 | 2 |
| 10 | 695 | 50 | 1 |

The homogenization of the plates was carried out as follows:

For examples 1, 2, 4, 5, 7, 8 and 10:

Rise at a speed of 30° C./h to 440° C.,

Maintenance for 5 hours at 440° C.,

Rise at a speed of 20° C./h to 510° C.,

Maintenance for 2 h at 510° C., descent at a speed of 20° C./h to 490° C., then hot rolling.

For examples 3, 6, and 9:

Rise at a speed of 30° C./h to 535° C.,

Maintenance for 12 h at 535° C., descent at a speed of 20° C./h to 490° C., then hot rolling.

Examples 1 and 2, which are according to the invention, and example 3 (which results in a microstructure outside the invention) correspond to composition 1.

Examples 4 and 5, which are according to the invention, and example 6 (which results in a microstructure outside the invention) correspond to composition 2.

Examples 7 and 8, which are according to the invention, and example 9 (which results in a microstructure outside the invention) correspond to composition 3.

Example 10 (which results in a microstructure outside the invention) corresponds to composition 4, which is outside the scope of the invention.

After a reheating for 20 h to a temperature higher than 500° C., the plates were hot-rolled to a final thickness of 14 mm.

The samples of the rolled sheets were characterized by techniques known to one skilled in the art. The tensile strength $R_m$ and the yield strength $R_{0.2}$ were measured in these sheets. These measurements make it possible to globally evaluate a first aspect of the product's suitability to the anticipated use, the present invention nevertheless remaining unrelated to an improvement of the static mechanical properties.

According to the method disclosed above, the number, the surface fraction and the size distribution of the eutectic $Mg_2Si$ and AlFeMnSi precipitates were measured by image analysis. For purposes of characterization after welding, samples were prepared by a shipyard by means of continuous MIG butt welding, with a symmetrical chamfer with a 45° slope relative to the vertical on a thickness of 6 mm, with a filler wire made of alloy 5183. The welding was done parallel to the rolling direction.

The corrosion resistance was measured by weight loss after immersion and by measuring the depth of the intergranular corrosion. The immersion was carried out in the "inter-acid" bath described in the Official Journal of the European Community of Sep. 13, 1974 (No. C 10484). It involves an immersion for 24 hours in a bath composed of NaCl (30 g/l), HCl (5 g/l) and distilled water, at a temperature of 23° C.±0.5° C., the liquid volume being greater than 10 ml per $cm^2$ of sample surface. After immersion, the samples were subjected to a thermal sensitization by being heated to 100° C. for a variable duration between 1 and 30 hours.

The deformation at cutting was measured in the following way:

A band with a width of 130 mm was cut by sawing from the middle of a sheet with a width of 2,000 mm and a length of 2,500 mm in the H22 temper, parallel to its length. This band was laid on a surface plate, and the deformation of the raised ends, as expressed by the distance between the edge of the band and the surface of the surface plate, was measured.

Table 3 indicates the microstructure observed, and Table 4 summarizes the results of the other characterizations performed.

TABLE 3

| ex. | number $Mg_2Si$ phases 0.5–5 μm | % $Mg_2Si$ phases >5 μm in size | $Mg_2Si$ surf. fract. | no. of AlFeMn CrSi part. 0.5–5 μm | % of AlFeMn CrSi part. 0.5–5 μm | AlFeMn CrSi surf. fract. % | disper-soid surface fract. % |
|---|---|---|---|---|---|---|---|
| 1 | 416 | 16 | 0.24 | 1,510 | 18 | 1.8 | 1.6 |
| 2 | 222 | 21 | 0.21 | 2,088 | 20 | 2.3 | 1.4 |
| 3 | 140 | 28 | 0.19 | 2,800 | 32 | 2.8 | 1.0 |
| 4 | 812 | 14 | 0.53 | 1,422 | 15 | 1.7 | 1.0 |
| 5 | 548 | 20 | 0.46 | 1,950 | 17 | 2.3 | 0.9 |
| 6 | 152 | 30 | 0.40 | 2,002 | 28 | 2.5 | 0.5 |
| 7 | 1,024 | 10 | 0.76 | 859 | 15 | 0.8 | 0.7 |
| 8 | 408 | 18 | 0.68 | 1,035 | 18 | 1.0 | 0.6 |
| 9 | 160 | 38 | 0.62 | 1,264 | 22 | 1.2 | 0.2 |
| 10 | 145 | 10 | 0.09 | 1,390 | 17 | 1.8 | 1.2 |

TABLE 4

| ex. | Depth of pitting after sensitization for 10 days at 120° C. | Depth of pitting after sensitization for 40 days at 120° C. | Yield strength of the welded joint MPa |
|---|---|---|---|
| 1 | 135 | 250 | 155 |
| 2 | 170 | 280 | 152 |
| 3 | 400 | 650 | 145 |
| 4 | 110 | 200 | 137 |
| 5 | 160 | 240 | 135 |
| 6 | 320 | 540 | 130 |
| 7 | 80 | 150 | 125 |
| 8 | 150 | 220 | 120 |
| 9 | 280 | 450 | 118 |
| 10 | 400 | 680 | 145 |

It is noted that examples 1, 2, 4, 5, 7 and 8 are distinguished by a particularly shallow pitting depth relative to examples 3, 6 and 9 corresponding to the prior art, and relative to example 10, which gives the worst result, which is to be expected for an AlMgMn alloy with a high magnesium content produced according to the prior art.

The yield strength of the welded joint is very good for examples 1, 2, 3 and 10, and good enough for examples 7, 8 and 9, which are rich in magnesium. However, example 10 is unusable due to its low corrosion resistance. On the other hand, the good resistance of the sheet in example 7 makes it suitable for applications in welded construction intended for a highly corrosive environment and constitutes an improvement relative to the prior art represented by example 9.

Surprisingly, the best compromise between the yield 5 strength of the welded joint and the corrosion resistance is obtained for composition 1, the richest in magnesium, on condition that the specific microstructure is obtained (examples 1 and 2). Even for composition 2, which corresponds to the alloy 5083 traditionally used in this field, a notable improvement in the corrosion resistance associated with the specific microstructure (examples 4 and 5) is observed.

For certain samples, the deformation at cutting of sheets in the H22 temper (designation according to the standard EN 515) was evaluated.

TABLE 5

| ex. | Deformation at cutting after roller-straightening in mm | Deformation at cutting after roller-straightening and traction, in mm |
|---|---|---|
| 6 | 5.0 | 3.0 |
| 4 | 1.5 | 0.5 |
| 5 | 2.5 | 1.0 |

What is claimed is:

1. An AlMgMn aluminum alloy product for welded mechanical construction consisting essentially of (% by weight):

3.0<Mg<6.5, 0.2<Mn<1.0,

Fe<0.8, 0.05<Si<0.6,

Zn<1.3,

Cr less than 0.15, one or more of the elements Cu, Ti, Ag, Zr, V with a content of <0.30 each, and other elements and inevitable impurities <0.05 each and <0.15 in total, the alloy product comprising $Mg_2Si$ particles of a size between 0.5 μm and 5 μm, in an amount between 150 and 2,000 per $mm^2$ of area analyzed.

2. A product according to claim 1, wherein $Mg_2Si$ particles greater than 5 μm in size are present in an amount less than 25% of all $Mg_2Si$ particles greater than 0.5 μm in size.

3. A product according to claim 1, wherein the $Mg_2Si$ particles are present in a surface fraction of <1%.

4. A product according to claim 1, wherein the alloy also comprises AlFeMnSi, $Al_6$(Mn,Fe) and AlFeCr particles greater than 0.5 μm in size in an amount less than 5,000 per $mm^2$.

5. A product according to claim 4, wherein AlFeMnSi, $Al_6$(Mn,Fe) and AlFeCr particles greater than 0.5 μm in size are present in a surface fraction less than 3%.

6. A product according to claim 5, wherein the surface fraction of the AlFeMnSi, $Al_6$(Mn,Fe) and AlFeCr phases greater than 0.5 μm in size is less than 2.5%.

7. A product according to claim 4, wherein AlFeMnSi, $Al_6$(Mn,Fe) and AlFeCr particles greater than 5 μm in size are present in an amount less than 25% of all particles greater than 0.5 μm in size.

8. A product according to claim 7, wherein the number per $mm^2$ of the AlFeMnSi, $Al_6$(Mn,Fe) and AlFeCr phases greater than 5 μm in size represents less than 20% of all the phases greater than 0.5 μm in size.

9. A product according to claim 4, wherein the number of AlFeMnSi, $Al_6$(Mn,Fe) and AlFeCr particles greater than 0.5 μm is less than 2,500 per $mm^2$.

10. A product according to claim 1, wherein dispersoids less than 0.2 μm in size are present in an amount greater than 0.5%.

11. A product of claim 10, wherein the dispersoids are present in an amount greater than 1%.

12. A product according to claim 1, wherein intergranular corrosion after an "Interacid" test, on sheets aged during 10 days at 120° C., is present to a depth less than 400 μm.

13. A product according to claim 12, wherein the intergranular corrosion is present to a depth less than 200 μm.

14. A product according to claim 1, having a yield strength after welding greater than (40+20×% Mg) Mpa.

15. A product according to claim 1, having a deformation at cutting measured at the H22 temper after leveling and stretching of less than 3 mm.

16. A product according to claim 1, having a deformation at cutting measured at the H22 temper after leveling and stretching of less than 5 mm.

17. A product for ship building according to claim 1, having a Zn content <0.5.

18. A product for ship building according to claim 1, having a Zn content >than 0.5 and a protective coating on a welded zone.

19. A hot-rolled strip made from an Al—Mg—Mn aluminum alloy consisting essentially of, in % by weight:

3.0<Mg<6.5, 0.2<Mn<1.0,

Fe<0.4, 0.05<Si<0.6,

Zn<1.3,

Cr<0.15, one or more of the elements Cu, Ti, Ag, Zr, V with a content <0.30 each, and other elements and inevitable impurities <0.05 each and <0.15 in total, said strip having a width of at least 2,500 mm, and comprising $Mg_2Si$ particles of a size between 0.5 μm and 5 μm in an amount between 150 and 2,000 per $mm^2$ of area analyzed.

20. A product according to claim 19, wherein said particles are present in an amount of between 30 and 1,500 per $mm^2$.

* * * * *